US007143583B2

(12) United States Patent
Hayashi et al.

(10) Patent No.: US 7,143,583 B2
(45) Date of Patent: Dec. 5, 2006

(54) GAS TURBINE COMBUSTOR, COMBUSTION METHOD OF THE GAS TURBINE COMBUSTOR, AND METHOD OF REMODELING A GAS TURBINE COMBUSTOR

(75) Inventors: Akinori Hayashi, Chiyoda-machi (JP); Shinichi Inage, Hitachi (JP); Hiromi Koizumi, Hitachi (JP); Isao Takehara, Hitachi (JP); Kazuyuki Ito, Hitachinaka (JP); Toshifumi Sasao, Mito (JP); Hidetaro Murata, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/382,500

(22) Filed: Mar. 7, 2003

(65) Prior Publication Data

US 2004/0035114 A1 Feb. 26, 2004

(30) Foreign Application Priority Data

Aug. 22, 2002 (JP) ..... 2002-241291

(51) Int. Cl.
*F02C 3/00* (2006.01)
*F23R 3/18* (2006.01)

(52) U.S. Cl. ..... 60/776; 60/737; 60/748; 60/747; 60/749

(58) Field of Classification Search ..... 60/737, 60/746, 747, 748, 749, 776
See application file for complete search history.

(56) References Cited

U.S. PATENT DOCUMENTS 2,715,813 A 8/1955 Holmes et al.
2,984,979 A 5/1961 Babcock et al.
4,955,191 A * 9/1990 Okamoto et al. ..... 60/746
5,228,283 A * 7/1993 Sciocchetti ..... 60/737
5,285,632 A * 2/1994 Halila ..... 60/747
5,437,159 A 8/1995 Ansart et al.
5,660,045 A * 8/1997 Ito et al. ..... 60/737
5,836,164 A * 11/1998 Tsukahara et al. ..... 60/737
5,899,074 A * 5/1999 Komatsu et al. ..... 60/737
6,026,644 A * 2/2000 Ito et al. ..... 60/737
6,038,861 A * 3/2000 Amos et al. ..... 60/737
6,082,111 A * 7/2000 Stokes ..... 60/737
6,327,861 B1 * 12/2001 Sato et al. ..... 60/746
6,732,528 B1 * 5/2004 Akagi et al. ..... 60/746

FOREIGN PATENT DOCUMENTS

EP 59208131 11/1984
JP 3-255815 11/1991
JP 08-14562 * 1/1996
JP 11-94255 4/1999

* cited by examiner

*Primary Examiner*—Ted Kim
(74) *Attorney, Agent, or Firm*—Mattingly, Stanger, Malur & Brundidge, P.C.

(57) ABSTRACT

A gas turbine combustor comprises a premixed combustion burner disposed on the periphery of a pilot burner, an approximately cylindrical combustor liner disposed on the downstream side of the premixed combustion burner, which defines a combustion chamber in the liner. The gas turbine combustor is characterized by further comprising flame stabilizers radially disposed at the exit of the premixed combustion burner, and a fuel injection means with which the pilot burner is provided injects at least one of gas fuel and liquid fuel, in which a plurality of air nozzles are provided which are located outside the pilot burner and inside the premixed combustion burner, and which spout out air into the combustion chamber. Adequate combustion can be accomplished with a combustor which is capable of using gas fuel and liquid fuel, and at the same time, NOx can be reduced.

12 Claims, 11 Drawing Sheets

GAS TURBINE COMBUSTOR, COMBUSTION METHOD OF THE GAS TURBINE COMBUSTOR, AND METHOD OF REMODELING A GAS TURBINE COMBUSTOR

BACKGROUND OF THE INVENTION

The present invention relates to a gas turbine combustor, a combustion method of the gas turbine combustor and a method of remodeling a gas turbine combustor.

Examples of conventional gas turbine combustors using both a premixed combustion method and a diffusion combustion method are disclosed by Patent Documents 1 and 2, etc.

[Patent Document 1]

Japanese Patent Laid-open No. 11-94255

[Patent Document 2]

Japanese Patent Laid-open No. 3-255815

With the technique described in Patent Document 1, liquid fuel not evaporated completely and remained in the evaporating process after injection sticks to the flame stabilizers as it is. The stuck fuel is carbonated, and this is likely to cause a caulking phenomenon. This poses problems that self-ignition of air fuel mixture due to the char and flashback caused by flame flowing into the premixed combustion burner occur. There arise other problems that cooling performance is lowered at the char stuck portion of a structure and peeling-off chars collide against another structure to damage it. Further, the system has to be complicated because pre-evaporation premixed system is used together with the diffusion combustion system, which requires a means of preventing caulking in the fuel nozzle and maintenance work.

With the technique described in Patent Document 2, the same problems as described above occur even when the pre-evaporation premixed combustion system uses liquid fuel. Further, when a plurality of combustors are disposed on the outer circumference of a gas turbine, and premixed combustion burners are coaxially disposed on the outer circumference of a diffusion combustion burner which is a pilot burner, air for premixing covers around diffuse flame which is a pilot flame. This poses a problem that the diffusion flame cannot reach the cross-fire tube connected to the side wall of the combustor, which makes it impossible to ignite the adjacent combustor.

Further, when pre-evaporation mixing is made using liquid fuel, pre-evaporation cannot be made because air temperature at the time of ignition is too low. This requires use of a pilot burner, and the above-described problem with flame transmission becomes more significant.

SUMMARY OF THE INVENTION

Accordingly, an object of the present invention is to provide a gas turbine combustor that makes adequate combustion with a combustor for which gas fuel and liquid fuel can be used, and that is excellent in minimizing NOx, a combustion method of the gas turbine combustor, and a method of remodeling a gas turbine combustor.

Flame stabilizers are arranged radially in the exit of the premixed combustion burner, and air is spouted out at the position outside the pilot burner and inside said premixed combustion burner.

BRIEF DESCRIPTION OF THE DRAWINGS

Other objects and advantages of the invention will become apparent from the following description of embodiments with reference to the accompanying drawings in which.

DETAILED DESCRIPTION OF THE PREFERRED EMBODIMENTS

Figure 1:
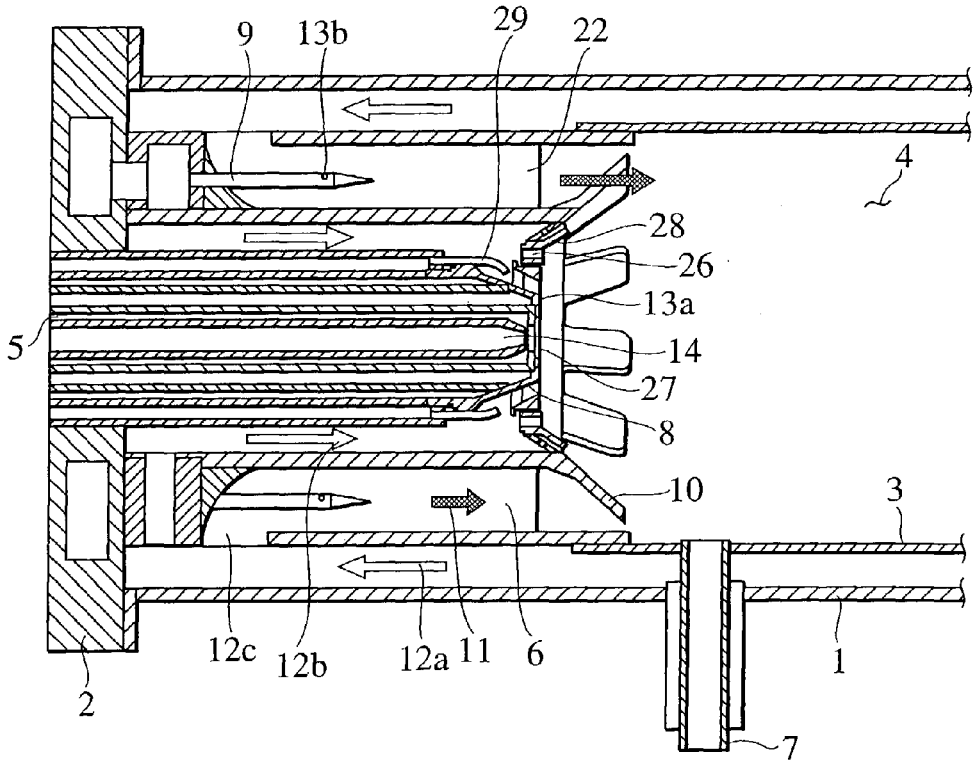
FIG. 1 is a sectional view of a gas turbine combustor according to the present invention.

A gas turbine combustor comprises a pilot burner, a premixed combustion burner disposed on the outer circumference of the pilot burner, and a combustor liner in an approximately cylindrical shape which is disposed on the downstream side of the premixed combustion burner, and which defines a combustion chamber in the inner wall. In addition, the gas turbine combustor comprises flame stabilizers radially disposed at the exit of the premixed combustion burner, and a plurality of air nozzles located inside the premixed combustion burner, which spout out air into the combustion chamber. The pilot burner is provided with a fuel injection means which injects at least one of gas fuel and liquid fuel. Since flame stabilizers are radially disposed at the exit of the premixing burner, fuel of the pilot burner forms flame on the flame stabilizing surface. When gas fuel is used, premixed flame is stabilized, and when liquid fuel is used, mixing of air ejected from the premixed combustion burner with fuel of the pilot burner is promoted, preventing extension of diffusion flame. Further, the air nozzle between the pilot burner and premixed combustion burner prevents a rise in the temperature of the flame stabilizing surface, and stabilizes diffusion flame.

Further, a temperature distribution at the exit of the combustor can be uniformed by providing radially disposed flame stabilizers. This further contributes to protection of the turbine. Here, the radially disposed flame stabilizers have a shape in which a plurality of projections project from the inner circumference side to the outer circumference side (outside in the radial direction) of the flame stabilizers, as viewed from the combustion chamber to the pilot burner.

Further, the gas turbine combustor is provided with the flame stabilizers radially disposed at the exit of the premixed combustion burner and a cross-fire tube provided with an opening which is disposed in the side wall of the liner and which is circumferentially aligned with at least one of the flame stabilizers. The cross-fire tube is connected to the side wall of the combustor liner by way of the opening which is circumferentially aligned with one of the cross-fire tubes as described above. With this construction, of diffusion flame reached the exit of the premixed combustion burner, only flame diffused along flame stabilizing surface of the flame stabilizers, without being diluted by premixture, reaches the cross-fire tube positioned in the outer periphery side, allowing another combustor to be ignited.

Further, the flame stabilizers are each inclined so that the outer circumferential side is positioned on the downstream side relative to the inner circumferential side at the edge on the downstream side, and desirably, the inclination angle relative to the center axis of the combustor is set to 30° or more and 60° or less. With this construction, premixed combustion gas on the outer circumferential side deflects in the direction in which the premixed combustion gas on the outer circumferential side converges to the axial center of the combustor after passing through the edge downstream of the flame stabilizers, causing diffusion combustion gas on the inner circumferential side to be diluted and mixed sufficiently. As a result, extension of diffusion flame is prevented to reduce production of NOx, and occurrence of combustion temperature deviation at the combustor exit is prevented, protecting damage to turbine blades.

The radially disposed flame stabilizers are slanted so that the outer circumferential side thereof is positioned on the downstream side thereof relative to the inner circumferential side at edges on the downstream side. This arrangement is effective in further improving stability of flame.

Further, the inner circumference of the flame stabilizers are fixed to the premixed combustion burner, and the edges on the outer circumferential side of the flame stabilizers are separated from the premixed combustion burner outer circumferential wall. With this construction, stress caused by thermal expansion of the flame stabilizers and the like can be released. Further, with this construction, premixture or air ejected into the combustion chamber through the space between the edge on the downstream side of the flame stabilizers and premixed combustion burner outer circumferential wall prevents a rise in the temperature of combustion chamber sidewall due to diffusion flame.

Further, the air nozzle is configured in such a manner to spout out air swirlingly. With this structure, air is spread by the swirling, improving cooling of the flame stabilizing surface. In addition, expansion of a swirl flow range made by the swirling air further stabilizes diffusion flame.

Further, a slit is provided outside the air nozzle and inside the premixed combustion burner. The slit is provided with a means of allowing air to flow toward the flame stabilizers. With this construction, air in a film state ejected from the slit covers the flame surface, improving cooling performance.

Further, the air inlet portion or the air outlet portion of the pilot burner is provided with a nozzle capable of ejecting water or steam. This nozzle supplies water or steam to near the fuel injection unit at the time of diffusion combustion of liquid fuel, effectively reducing NOx.

Further, a partition is provided to divide a passage of the premixed combustion burner in the circumferential direction. With this partition, the drift of premixture (or air for premixing) which flows in the circumferential direction in the premixed combustion burner is suppressed. In addition, deviations of flow velocity and fuel concentration at the exit of the premixed combustion burner are reduced, causing NOx to be reduced and preventing flashback.

Further, the flame stabilizers are each disposed in such a manner as to be positioned between the partition and a partition adjacent thereto. With this arrangement, the circumferential drift of premixture (or air for premixing) which flows on the circumferential side of the flame stabilizer is suppressed. In addition, deviations of flow velocity and fuel concentration at the exit of the premixed combustion burner are reduced, causing NOx to be reduced and preventing flashback.

Further, the partition is so arranged as to project into the combustion chamber toward the downstream side of the flame stabilizers. With this arrangement, a stabilized premixed swirl flow can be formed downstream of the flame stabilizing surface, improving stability of the premixing flame.

Further, the flame stabilizers are provided with a plurality of nozzles which spout out premixture or air into the combustion chamber. With this structure, flame surface cooling performance is improved. In addition, in a case of the premixture, jet flame on the flame surface can attain the stabilization of premixed flame.

Further, the edge of the inside wall of the premixed combustion burner has an inclined surface in which, from the upstream toward the downstream, the cross-sectional area of the premixture or air passage of the premixed combustion chamber is enlarged. With this inclined surface, the premixture or air for premixing is likely to flow into the combustion chamber toward the combustor center axis. This improves mixing performance with diffusion fuel and reduces NOx.

Further, a fuel nozzle which is capable of directly injecting auxiliary fuel into the combustion chamber is provided between the flame stabilizers and the pilot burner. Alternatively, a nozzle capable of injecting auxiliary fuel and an air passage are provided between the premixed combustion burner and the pilot burner. With this nozzle and air passage, fuel and air are mixed in advance. Thus, a second premixture combustion burner is provided to burn the premixture in the combustion chamber. Alternatively, a means which is capable of injecting auxiliary fuel to a passage for air or the premixture of the premixed combustion burner is provided between the flame stabilizers disposed radially and the flame stabilizers circumferentially adjacent thereto, and downstream of the fuel injection nozzle of the premixed combustion burner. With this construction, carry-over of diffusion flame and premixed flame can surely be made by charging the auxiliary fuel when burning gas fuel. At the same time, oscillatory combustion can be reduced by dispersing fuel supply positions in the radial direction of the combustion chamber.

Further, the premixed combustion burner is configured so that fuel is controllably supplied by a plurality of fuel nozzles divided into several groups. In addition, the premixed combustion burner has a control method in which a combination of fuel nozzles injecting fuel of fuel nozzles divided in response to gas turbine loads is changed. With this configuration, the total fuel flow can be controlled in response to loads while maintaining the stability of premixed flame at the time of gas fuel combustion.

Figure 2:
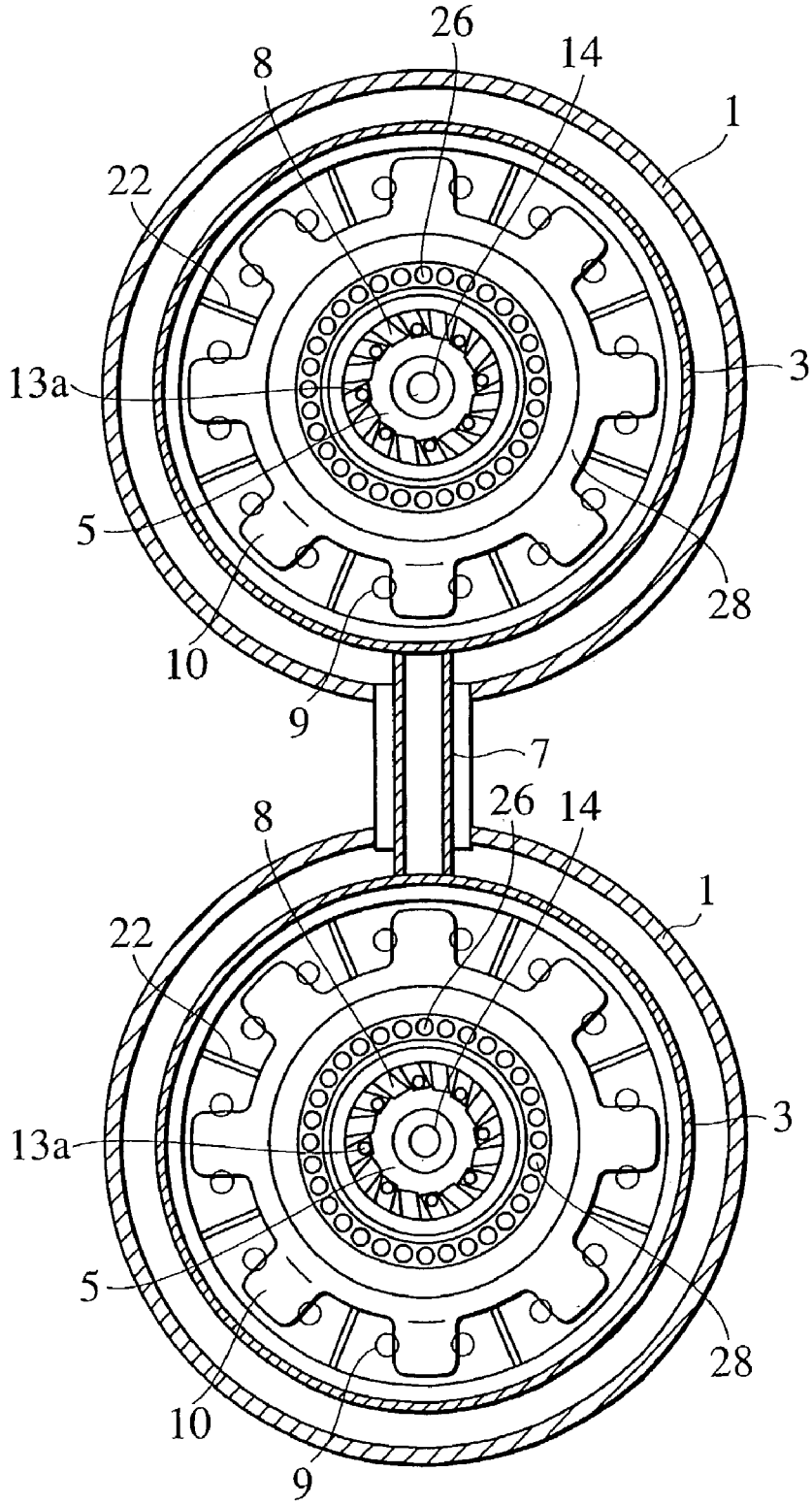
FIG. 2 is a sectional view showing a configuration wherein two combustors are connected with a cross-fire tube.
Figure 3:
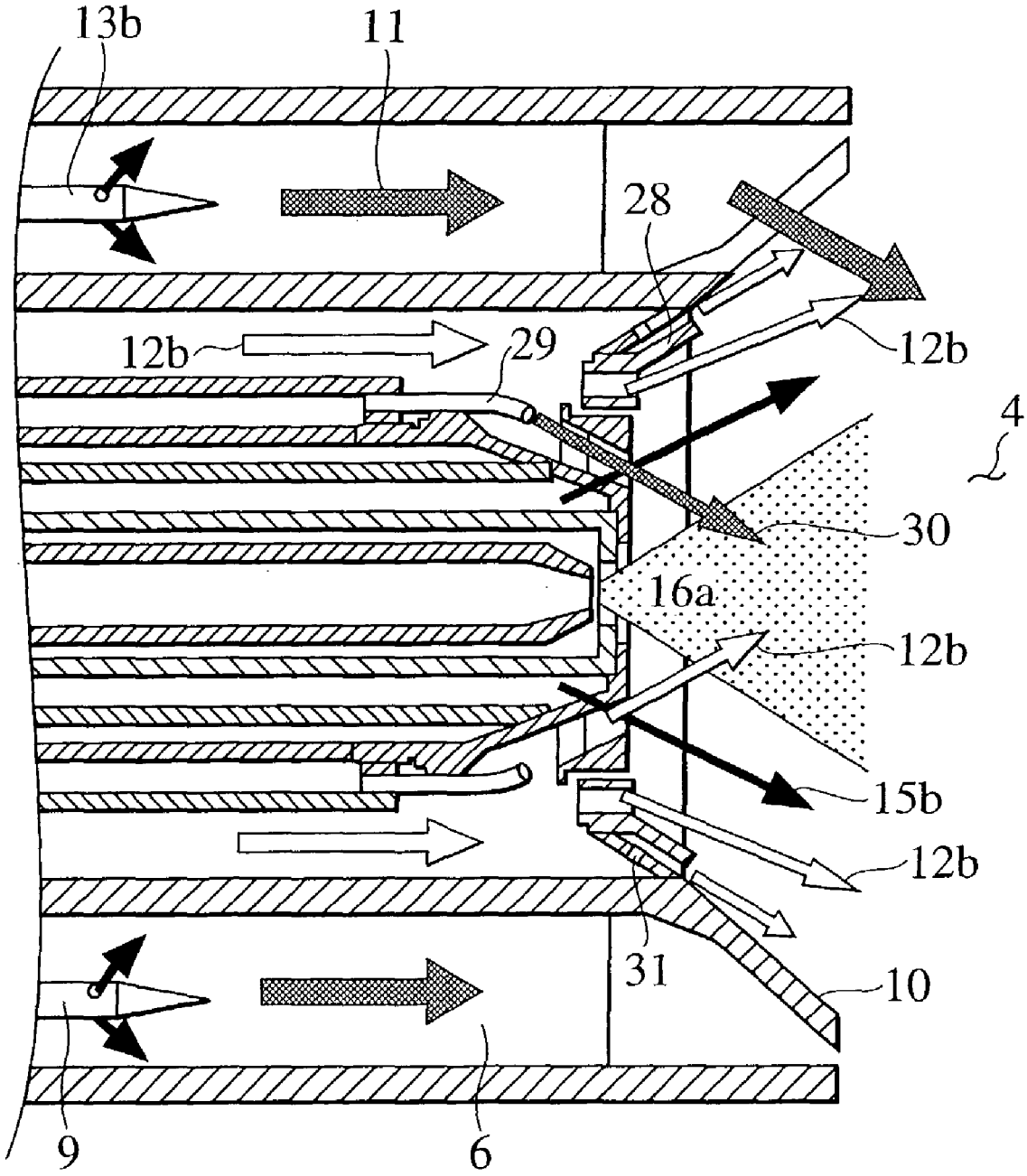
FIG. 3 is a sectional view of fuel nozzles and flame stabilizers of the combustor.

The schematic configuration of a gas turbine combustor according to a first embodiment of the present invention is illustrated in FIGS. 1 through 3. As shown in FIG. 1, the combustor is surrounded by an outer casing 1 and an end flange 2, and comprises a combustion chamber 4 surrounded by a liner 3, a diffusion swirl burner 5 which makes diffusion combustion, a premixer 6 which mixes fuel with air to create a premixture, a cross-fire tube 7 which propagates flame to the other combustor at the time of ignition, and a fuel and air supply systems.

The diffusion swirl burner 5 disposed on the central axis of the combustor circulates diffusion combustion air 12*b* distributed from combustion air 12*a* with a swirl blade or swirler 8. Further, the diffusion swirl burner 5 mixes the air with gas 13*a* or fuel ejected from a liquid fuel nozzle 14 in the combustion chamber 4, forming a diffuse flame. A plurality of swirl combustion air nozzles 26 for supplying diffusion combustion air 12*b* into the combustion chamber 4 is provided on the surrounding of the diffusion swirl burner 5. An atomizing air nozzle 27 is provided on the surrounding of liquid fuel nozzle 14*a*. Liquid fuel for diffusion combustion is atomized by a jet stream of atomizing air supplied from the atomizing air nozzle 27. The air inlet of the swirler 8 is provided with water injection nozzles 29. Through these nozzles, water is mixed with the diffusion combustion air 12*b* so as to supply steam 30 into the combustion chamber.

The annular premixer 6 provided on the surrounding of the diffusion swirl burner 5 preliminarily mixes fuel ejected from gas 13*b* which is injected out from a plurality of premixing fuel nozzles 9 with air for premixing 12*c* distributed from combustion air 12*a* so as to create a premixture 11. Flame stabilizers 10 are provided in the entrance of the combustion chamber 4 located downstream of this premixture 11. The flame stabilizers 10 form premixed flame 18 to stabilize flame. The plurality of flame stabilizers 10 are disposed radially relative to the central axis of the combustor. Further, each of the flame stabilizers 10 is provided slantly relative to the central axis of the combustor. The premixer 6 is provided with partitions 22 so as to circumferentially divide the passage of the premixer 6 from the entrance of the premixer to the upstream of the flame stabilizers 10.

The flame stabilizers 10 disposed slantly relative to the combustor center axis may, as viewed from the side of the combustor, not only be in a near plane but also be in a slight convex or concave.

FIG. 2 is a transverse sectional view of two combustors of FIG. 1 coupled through the cross-fire tube 7. Eight flame stabilizers 10 are provided for each combustor. Each of the flame stabilizers 10 is disposed between and upstream of the partitions 22 of the premixer 6 and between and upstream of the fuel nozzles for premixing. Each end of the cross-fire tube 7 is connected to the liner 3 in a radial direction relative to one of the flame stabilizers 10 disposed in the combustor, thereby connecting two combustion chambers 4.

FIG. 3 is an enlarged sectional view of the diffusion swirl burner of the combustor indicated in FIG. 1. The function of each part and the flowing direction of fluid passing through each part are described hereunder. Diffusion combustion air 12*b* of the diffusion swirl burner is changed to a swirling flow of air by the swirler 8. Further, the air flows into the combustion chamber with a certain inward directional angle directed to the combustor center axis. Liquid fuel ejected from the liquid fuel nozzle is atomized by atomizing air. Since this atomized liquid fuel is rapidly mixed with the swirling flow of air, occurrence of soot caused by combustion with an insufficient air is prevented and stable diffuse flame can be formed. The water injection nozzles 29 provided upstream of the swirler 8 inject water toward the swirler 8 causing diffusion combustion air 12*b* to be mixed with water. Further, thereafter, water is rapidly mixed with liquid fuel in the combustion chamber 4, so that heating density of fuel can be efficiently lowered and NOx can be reduced. The gas fuel nozzles provided near the air outlet of the swirler 8 spout gas fuel 15*b* with a certain outward directional angle relative to the combustor center axis. When a flow of the spouted out gas fuel is small (when a load of the gas turbine is low), the velocity of flow of gas fuel is slow and penetrating force against diffusion combustion air 12*b* is small. For this reason, gas fuel for diffusion combustion 15*b* is mixed mainly with diffusion combustion air 12*b* to burn in the vicinity of the combustor center axis, allowing stable combustion. When a gas turbine load rises and gas fuel for diffusion combustion 15*b* increases, penetration force of gas fuel increases and it is mixed with air (premixture) flowing in from the swirl combustion air nozzles 26 and premixer 6, so that an NOx reduction due to lean combustion can be attained. The swirl combustion air nozzles 26 are disposed on the surrounding of the diffusion combustion burner so that diffusion combustion air 12*b* is allowed to flow into the combustion chamber in the same swirling direction as the swirler 8. This arrangement is to increase swirl flow in the vicinity of the combustor center axis and to stabilize flame. At the same time, the swirl flow expands air toward the premixer 6, preventing sticking of diffuse flame to the face, of the flame stabilizers 10, in contact with the combustion chamber 4 and a temperature rise of the flame stabilizers 10. A slit 28 is provided on the periphery of the swirl combustion air nozzles 26, so that diffusion combustion air is formed in a film state, and is allowed to flow out to the face, of the flame stabilizers 10, in contact with the combustion chamber 4. With this configuration, a temperature rise of the flame stabilizers 10 is further prevented. The flame stabilizers 10 disposed slantly relative to the combustor center axis make the passage of the annular premixer 6 narrow in the circumferential direction, and at the same time, wide in the inclined direction. Therefore, an increase in pressure loss at the premixer 6 is suppressed, and at the same time, the air for premixing 12*c* or premixture 11 is ejected from the premixer 6 in the direction of the combustor center axis of the combustion chambers 4.

The flame stabilizers 10 are slantly disposed so that its outer circumferential side is positioned on the downstream side relative to its inner circumferential side at the edge on the downstream side, and desirably, the inclination angle relative to the combustor center axis is set to 30° or more and 60° or less. With this configuration, after passing through the edge downstream of the flame stabilizers, the premixed combustion gas on the outer circumferential side deflects in the direction in which the premixed combustion gas converges to the axis center of the combustor, causing the diffusion combustion gas on the inner circumferential side to be diluted and mixed sufficiently. As a result, extension of the diffusion flame is prevented, reducing production of NOx, and occurrence of combustion temperature variations at the combustor exit is prevented, protecting turbine blades from being damaged.

Figure 13:
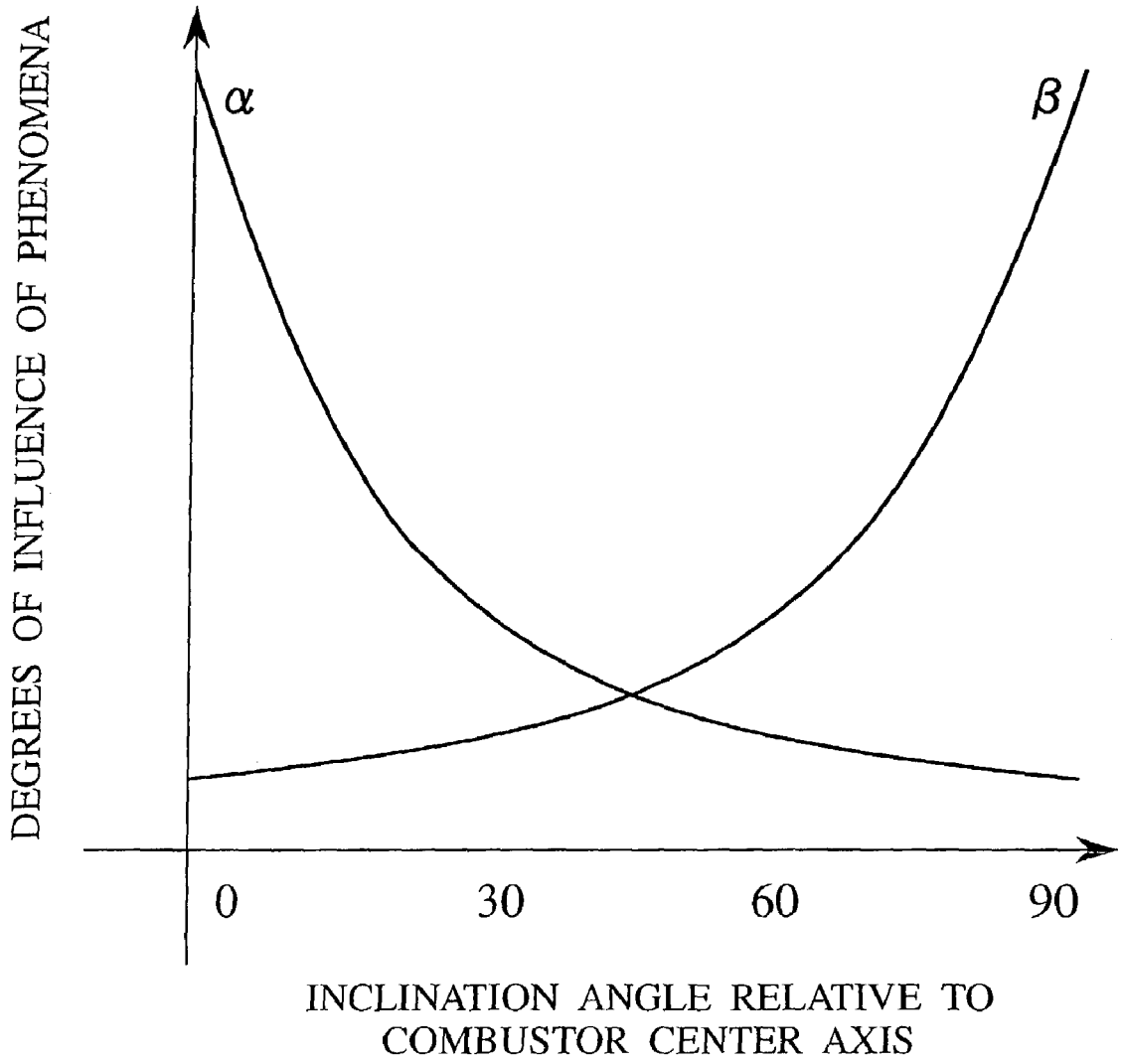
FIG. 13 is a diagram indicating the inclination angles of flame stabilizers relative to the combustor center axis and the degrees of influence of phenomena appearing depending on the inclination angle.

The reason why the inclination angle of the flame stabilizers 10 is set to 30° or more and 60° or less is explained. As shown in FIG. 13, as the inclination angle of flame stabilizers 10 relative to the combustor center axis reduces, the amplitude $\alpha$ of oscillatory combustion increases in the manner of an exponential function. When the inclination angle of the flame stabilizers 10 reduces, premixed combustion gas converges to the combustor center axis, causing high temperature diffusion combustion gas to be diluted. This further causes stability of flame to drop down and amplitude of oscillatory combustion to be increase. In particular, when an inclination angle reduces below 30°, amplitude of oscillatory combustion remarkably increases. A deviation of temperature β at the exit of the combustor increases in the manner of an exponential function as the inclination angle of the flame stabilizers 10 relative to the combustor center axis increases. Since the inclination angle of the flame stabilizers is large, an amount of displacement toward the direction in which the premixed combustion gas converges to the combustor axis center is small. For this reason, premixed combustion gas goes through the combustion chamber 4 approximately directly. Thus, diffusion combustion gas on the inner circumferential side is not sufficiently mixed with premixed combustion gas. Then, temperature distribution at the exit of the combustor is put out of balance, causing damage to the turbine blades in the downstream. In particular, when the inclination angle exceeds 60°, the temperature distribution at the exit of the combustor remarkably deviates. Thus, when both the influences of amplitude of oscillatory combustion and temperature deviation at the exit of the combustor are taken into considerations, it is desirable to set the inclination angle to 30° or more and 60° or less.

Figure 14:
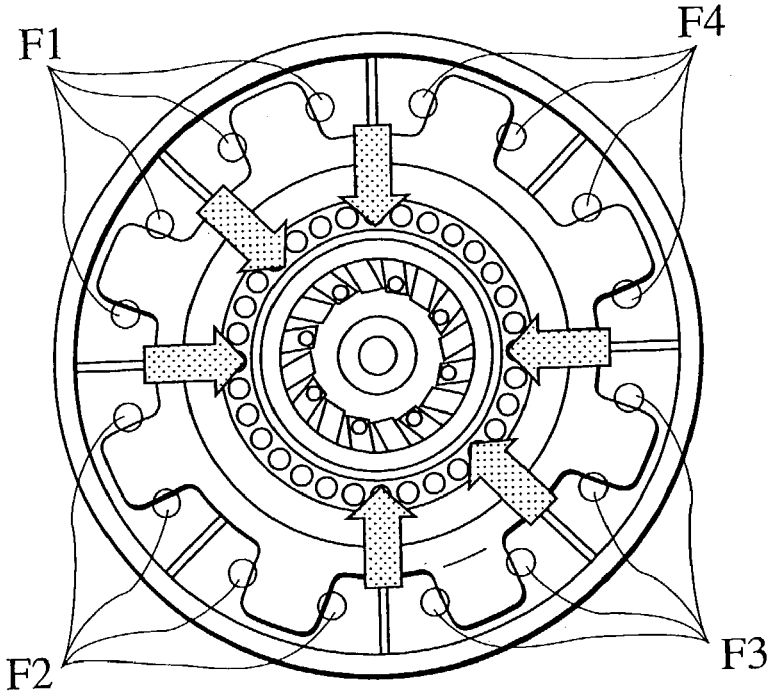
FIG. 14 is an end view of flame stabilizers showing a case in which premixed fuel passages are not uniform in the circumferential direction.
Figure 15:
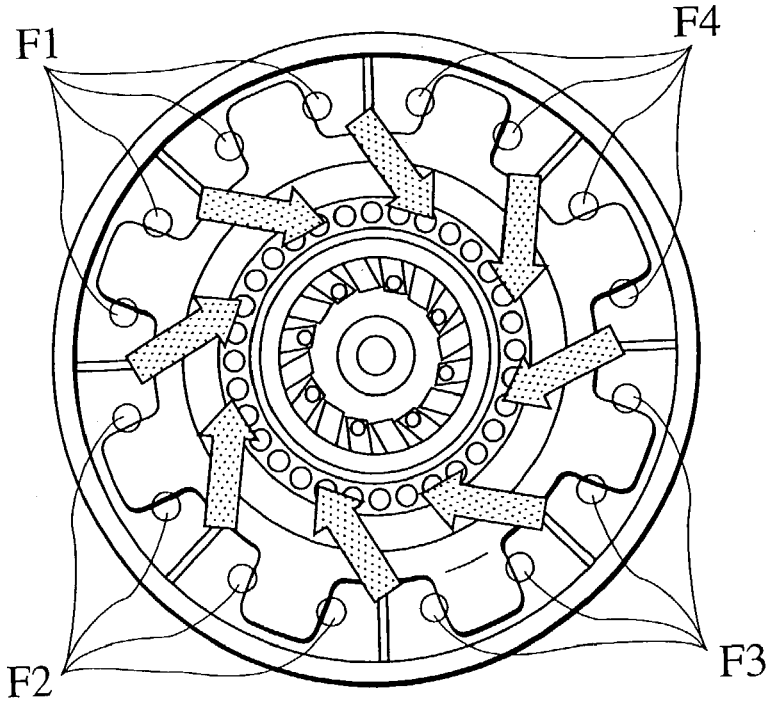
FIG. 15 is an end view of flame stabilizers showing a case in which the premixed fuel passages are provided with rotating components centered on the combustor axis center.

Next, a description will be made of the operating principle of a combustor provided with flame stabilizers disposed radially at the exit of a premixed combustion burner in a premixed type gas turbine combustor comprising a pilot burner, a premixed combustion burner disposed on the periphery of the pilot burner, and a combustor liner in an approximately cylindrical shape which defines a combustion chamber in the combustor liner. In the case of an annular premixed combustion burner without flame stabilizers disposed at the exit of the premixed combustion burner, premixed combustion gas flows into the combustion chamber 4 with the annular form thereof kept as is. This causes the flow of premixed combustion gas to cover up diffusion combustion gas spouted out from the pilot burner. The flow of the premixed combustion gas does not intend to actively put the flow of the diffusion combustion gas into disorder. Therefore, it is difficult to uniformly stir the premixed combustion gas with the diffusion combustion gas. Accordingly, the fuel is unevenly distributed, causing NOx to be produced. In contrast to this, flame stabilizers radially disposed at the exit of the premixed combustion burner are provided in the present embodiment. With these flame stabilizers, gas flowing out from the premixed combustion burner flows some portions and does not flow the other portions in the circumferential direction, which causes a distribution in which differences in the velocity of flow of fluid are alternately lined up in the circumferential direction. With the distribution like this, when gas fuel is used, premixed flame is stabilized, and when liquid fuel is used, mixing of air ejected from the premixed burner with the fuel of the pilot burner is promoted, preventing extension of diffusion flame. Since the temperature distribution at the exit of the combustor is uniformed, the turbine itself is protected, also. Further, a face of the flame stabilizers 10 that is in contact with the combustion chamber 4 is inclined toward the combustor center axis. With this arrangement, premixed combustion gas flowing out from the premixed combustion burner is deflected toward the direction in which the premixed combustion gas converges actively to the combustor axis center. Then, premixed combustion gas is crossed with the diffusion combustion gas flowing out from the pilot burner. Thus, mixing of gas is promoted, and production of NOx is reduced by preventing extension of diffusion flame. Further, occurrence of combustion temperature deviation at the exit of the combustor is prevented, and the turbine blades are protected from being damaged. The flame stabilizers 10 radially disposed at the exit of the premixed combustion burner and the face of the flame stabilizers that are in contact with the combustion chamber 4 are inclined relative to the combustor center axis. With the multiplier effects of these inclinations, stability of flame can be further improved. Further, the passages of the premixed gas extending from the face of flame stabilizers 10 that is in contact with the combustion chamber 4 are not always needed to be spaced equally in the circumferential direction. As shown in FIG. 14, even if the passages of premixed fuel 11 are spaced unequally, diffusion combustion gas spouted out from the pilot burner can be effectively diluted and mixed. Furthermore, as shown in FIG. 15, the passages of the premixed fuel 11 may be provided with rotating components centered on the axial center of the combustor. Providing the rotating components like this, additional effects to stir diffusion combustion gas and premixed combustion gas can be expected. Further, the purposes of the arrangement wherein the radially disposed flame stabilizers 10 inclined relative to the combustor center axis are provided at the exit of the premixed combustion burner are to prevent the premixed combustion gas from flowing into the combustion chamber 4 with the annular form thereof kept as is and to displace the premixed combustion gas to the diffusion combustion burner side. These purposes may be accomplished, for example, without providing flame stabilizers. To be more specific, annular premixed combustion burners disposed on the periphery of a pilot burner are divided in the circumferential direction with partitions, and the exit of the premixed combustion burner is faced to the side of the pilot burner. Then, premixed combustion gas flowing out from the premixed combustion burner is distributed so that strength of currents is lined up alternately in the circumferential direction, and the passage is displaced to the diffusion combustion burner side. Thus, it is possible to make the same premixed fuel passage as that when the radially disposed flame stabilizers 10 are provided. However, by forming flame stabilizers as described in the present embodiment, the purposes to prevent the premixed combustion gas from flowing into the combustion chamber 4 with the annular form thereof kept as is and to displace the premixed combustion gas to the side of the diffusion combustion burner can be accomplished by a simple construction.

Further, the flame stabilizers 10 are hold in a cantilever manner on the inner circumferential side. In other words, the flame stabilizers 10 are supported by (fixed to) the premixed combustion burner on the inner circumferential side, and the edges on the outer circumferential side of the flame stabilizers 10 are separate from the premixed combustion burner outer circumferential wall. With this configuration, stress caused by thermal expansion of the flame stabilizers 10 and the like can be released. Further, with this configuration, premixture 11 or air ejected into the combustion chamber through the space between the edge on the downstream side of the flame stabilizers 10 and premixed combustion burner outer circumferential wall prevents a temperature rise of combustion chamber side wall due to diffusion flame.

Figure 4:
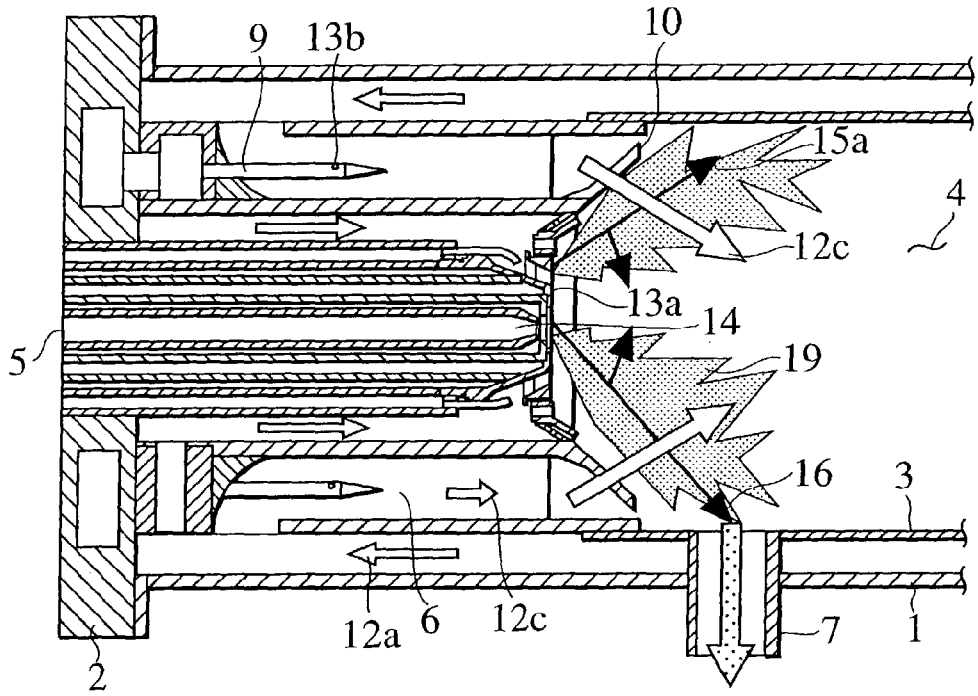
FIG. 4 is a sectional view of flame forms at the time of diffusion combustion of the combustor.
Figure 5:
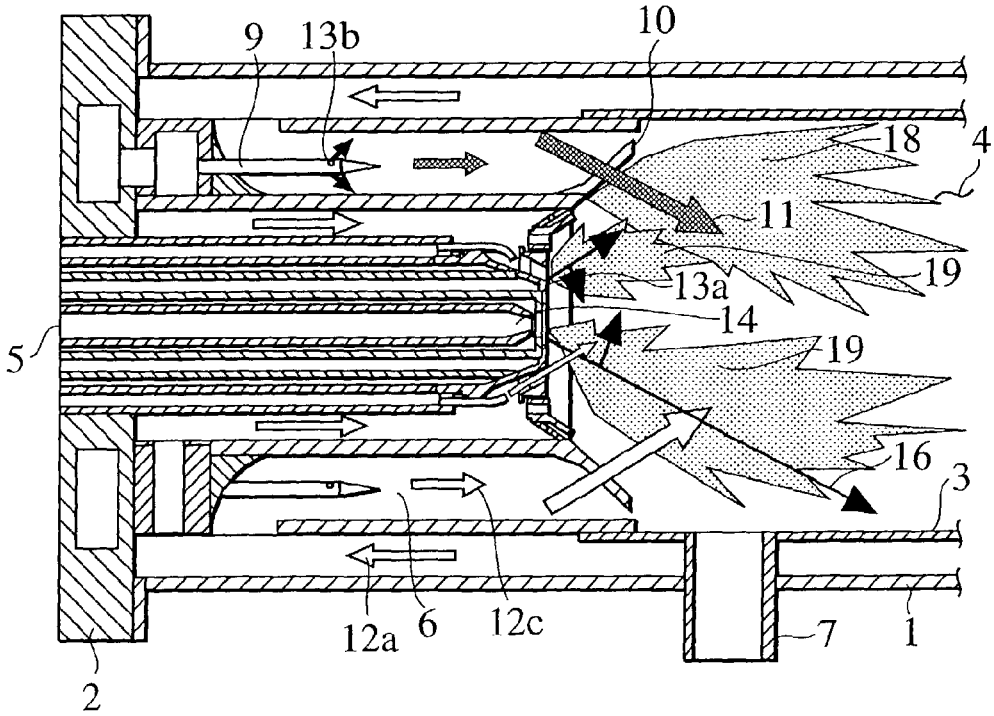
FIG. 5 is a sectional view of flame forms at the times of diffusion combustion and premixed combustion of the combustor.

In regard to the combustor shown in FIGS. 1, 2, and 3, examples of operating conditions and flame shapes at the time of gas fuel combustion and liquid fuel combustion are indicated in FIGS. 4 and 5.

FIG. 4 indicates a combustion state at the time of combustor ignition. The shape of flame at the time of gas fuel combustion is indicated on the upper side of the combustor center axis. The shape of flame at the time of liquid fuel combustion is indicated on the lower side of the combustor center axis. First of all, in one of the combustors, gas 15*b* or liquid fuel 16*a* is supplied to the diffusion swirl burner 5, and an ignition device is used to form diffuse flame 19. The gas 15*a* forms diffuse flame 19 after being mixed with diffusion combustion air 12*b*. Flame of the gas 15*a* is stabilized by the diffusion swirl burner 5. Further, the downstream of the flame stabilizers 10 is in a low velocity swirl flow region. For this reason, the diffuse flame 19 expands radially along each of the flame stabilizers 10. The cross-fire tube 7 is disposed on the outer circumference of the flame stabilizers 10, so that a high temperature combustion gas 20 is allowed to flow into the cross-fire tube 7 through the flame stabilizers 10 without being diluted by the air for premixing 12*c*, allowing the adjacent combustor to be ignited. Further, in a case of using gas fuel, another combustor is ignited by the cross-fire tube 7, premixing fuel 15*b* is supplied in addition to the gas 15*a*, and premixed flame 18 is also formed, whereby flame propagating performance can be enhanced.

After igniting the combustors, an amount of fuel supply is increased, and the gas turbine performs a speedup operation and a load operation. FIG. 5 shows flame shapes at the time of gas fuel combustion and liquid fuel combustion during the gas turbine operations respectively on the upper and lower sides of the combustor center axis. At the time of high load combustion with gas fuel, in order to attain diffusion combustion for stabilization of combustion and reduce NOx, premixing fuel is used to cause lean premixed combustion. The flame stabilizers 10 are arranged radially, and further, inclined toward the direction of the combustor center axis. With these flame stabilizers, diffuse flame 19 spreads radially in the radial direction of the combustor along the flame stabilizers 10, and premixing flame 18 grows in the direction of the combustor center axis. Thus, high temperature diffuse flame 19 and low temperature premixed flame 18 made by lean combustion cross each other in the circumferential direction of the combustor, thereby making momentary temperature at the combustor head uniform. The uniformity of momentary temperature at the combustor head promotes reduction of NOx and stabilization of combustion.

When liquid fuel is used, the diffuse flame 19 spreads radially along the flame stabilizers 10 as aforementioned. Further, with the inclined flame stabilizers 10, the air for premixing 12*c* flows out toward the combustor center axis, in other words, toward the downstream of the diffusion swirl burner 5. Then, mixing of the air for premixing 12*c* and combustion gas made by the diffuse flame 19 is promoted downstream of the combustion chambers 4, temperature deviation at the combustor exit is suppressed, whereby seizure of turbine blades can be prevented. Further, the diluting effect by the air for premixing 12*c* can prevent the long flame of the diffuse flame 19. As a result, a high temperature combustion region reduces, allowing reduction of the amount of NOx emission.

Further, since the space is defined between the flame stabilizers 10 and the outer circumferential wall of the premixer 6, and high velocity air or premixture spouts out along the combustion chamber wall surface, the combustion chamber wall surface is cooled down and a rise in temperature is prevented under all combustion states.

Figure 6A:
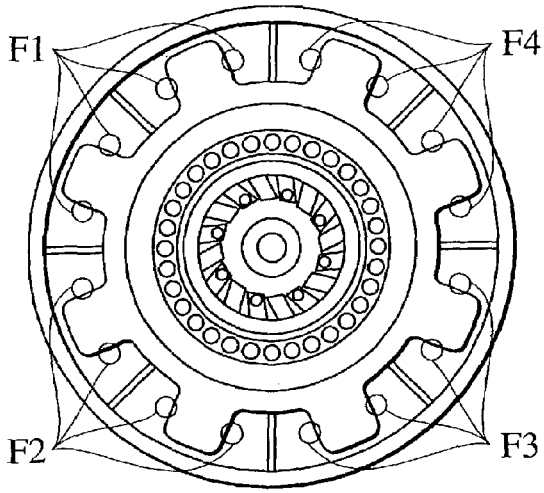
FIG. 6A is an end view of flame stabilizers.

FIG. 6 indicates an example of fuel and water flow control during the period from the ignition of the combustor to the rated load operation. As shown in FIG. 6A, the premixed fuel nozzles are divided into four sections (F1 through F4). With this construction, premixing gas fuel can be controlled by respective separate systems.

Figure 6B:
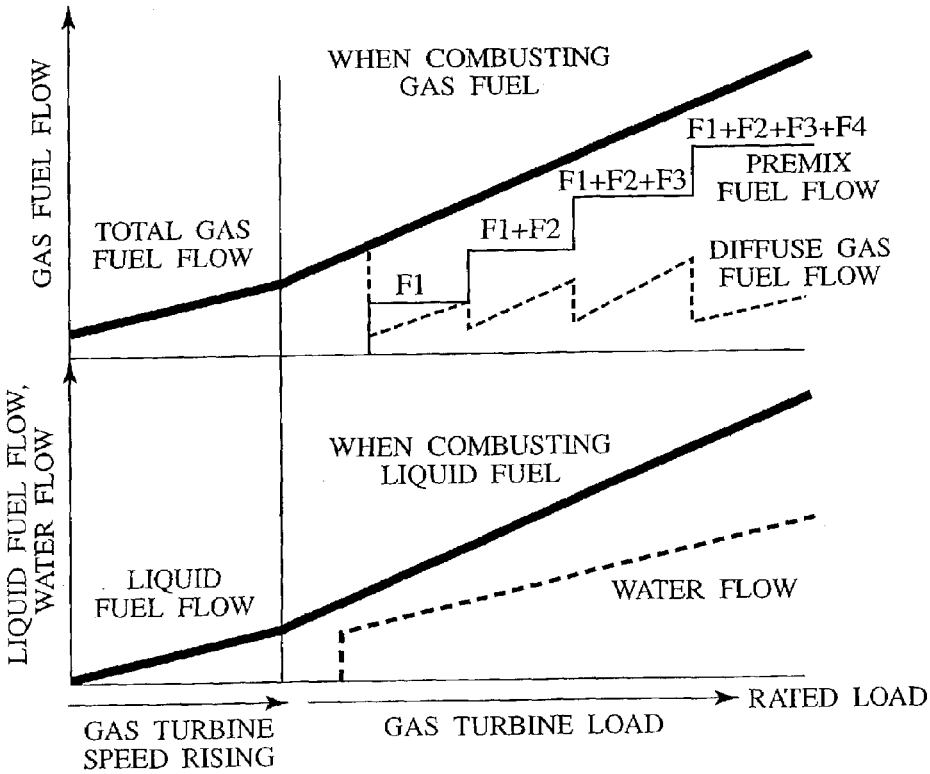
FIG. 6B is a diagram showing the relation of amounts of flows.

FIG. 6B indicates fuel flows for gas turbine loads at the time of gas fuel combustion and liquid fuel combustion. In the case of gas fuel combustion, the gas turbine combustor is operated with diffuse fuel during the period from ignition of the combustor to a certain partial load through the increased speed of the gas turbine. Thereafter, premixed fuel is charged sequentially from F1 up to F4 in response to load rising. By charging the premixing fuel in this stepping manner, the premixing fuel can be controlled with its mixing ratio of fuel to air kept at the optimum level, allowing control of the premixed combustion to prevent unstable combustion and flashback.

Further, at the time of liquid fuel combustion, the gas turbine combustor is operated by diffusion fuel only. However, water is charged at the time of a certain partial load in which combustion is stabilized, thereby intending to reduce the concentration of NOx.

Figure 7:
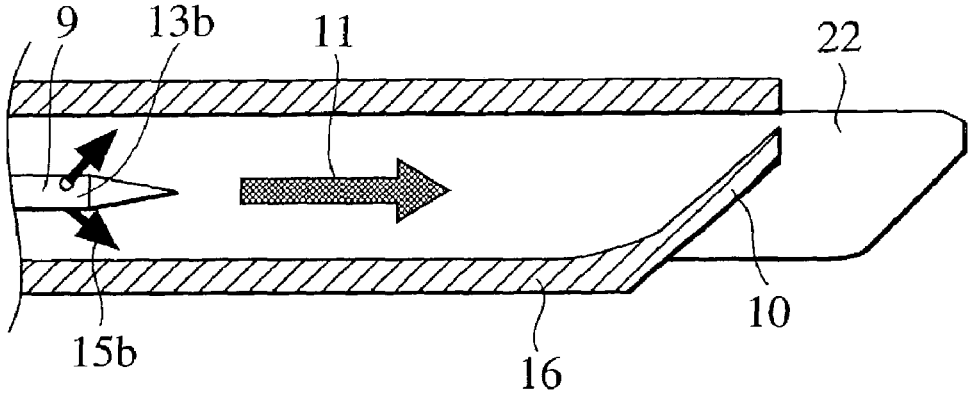
FIG. 7 is a partially enlarged sectional view of a premixer according to the present invention.
Figure 8:
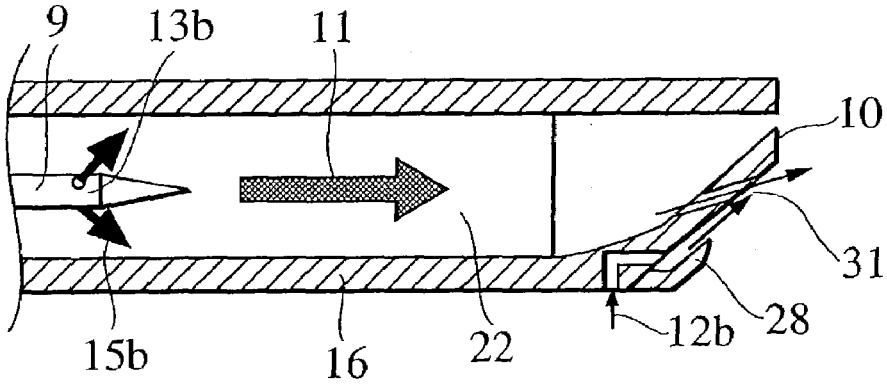
FIG. 8 is a partially enlarged sectional view of another premixer according to the present invention.
Figure 9:
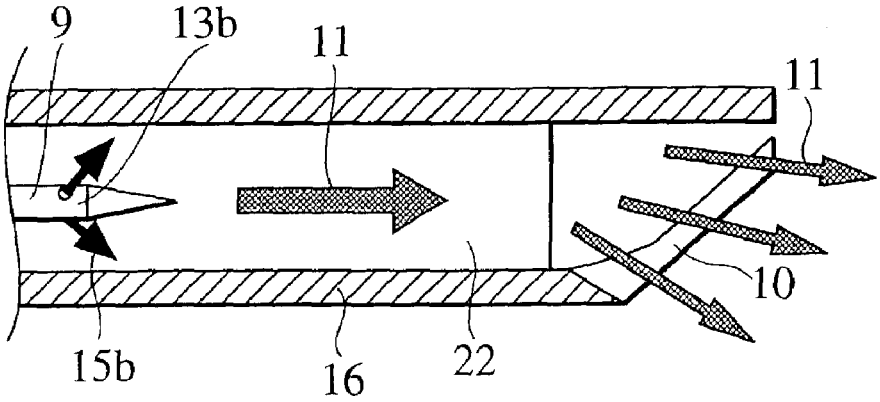
FIG. 9 is a partially enlarged sectional view of another premixer according to the present invention.

In the embodiment shown in FIGS. 1 to 3, the present invention is applied to other constructions of premixers 6 illustrated in FIGS. 7, 8, and 9, respectively.

FIG. 7 indicates a case in which partition 22 is disposed to extend from the flame stabilizers 10 to the downstream portion. This partition 22 circumferentially restrains the flow of a premixture from spaces among flame stabilizers 10 toward the downstream. With this design, the circulation flow formed at the face, of the flame stabilizers 10, in contact with the combustion chamber 4 can be stabilized, preventing unstable combustion and vibration combustion of the premixture.

In addition, NOx can be reduced and flashback can be prevented by reducing current deviation and fuel concentration deviation at the exit of the premixed combustion burner.

FIG. 8 indicates a construction in which a slit 28 and a plurality of cooling holes 31 are provided on the inner circumferential side of the flame stabilizer 10. The cooling holes 31 provided in the slit 28 spout film-like air branched out from diffusion combustion air 12*b* from the vicinity of the flame stabilizers toward the face, of the flame stabilizers 10, in contact with the combustion chamber 4. With this construction, a rise in the temperature of the flame stabilizer 10 can be securely prevented. Further, the flame stabilizer 10 can be directly cooled down by providing the flame stabilizer 10 with the cooling holes at a portion extending from the inside of the premixer 6 toward the downstream of the flame stabilizer 10. At the same time, the premixture ejected from the face, of the flame stabilizers 10, in contact with the combustion chamber 4 through the cooling holes can make jet stream flame, improving stability of premixing flame.

FIG. 9 indicates a construction of the edge of the inner wall of the premixer 6 between the flame stabilizers 10. In this construction, the edge has such an inclined surface as to enlarge the cross-sectional area of a passage for air or premixture 11 of the premixed combustion burner from the upstream part toward the downstream part. With this construction, in the combustion chamber, the premixture or air for premixing becomes easy to flow in toward the combustor center axis, thereby improving mixing performance with diffuse fuel and reducing NOx.

Figure 10:
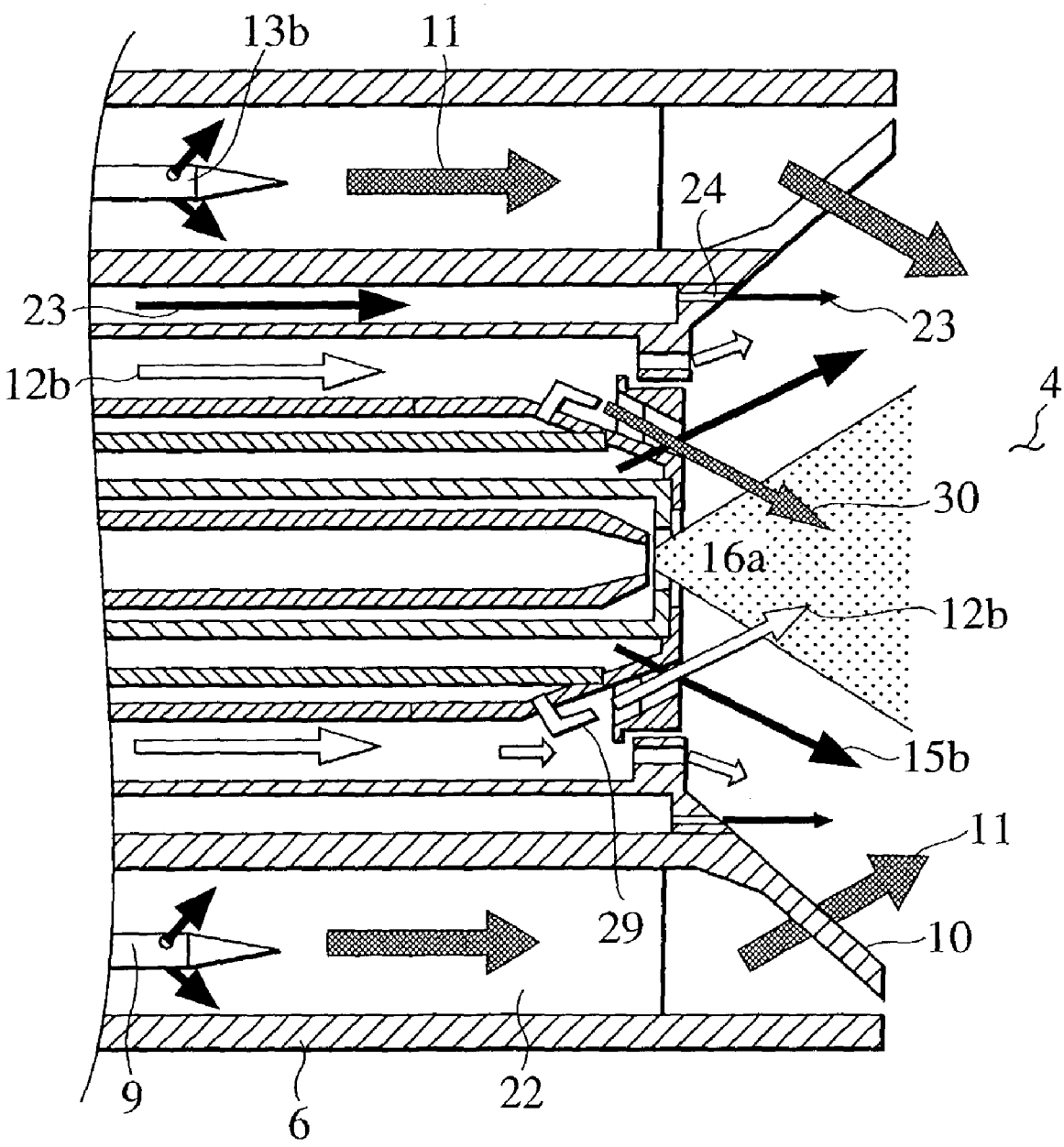
FIG. 10 is a sectional view of another combustor according to the present invention.

Another embodiment according to the present invention having a construction shown in FIG. 10 is described referring to the combustor shown in FIGS. 1 to 3. In this construction, a passage is made between the premixer 6 and diffusion swirl burner so as to supply auxiliary fuel 23 therethrough. In addition, a plurality of auxiliary fuel nozzles 24 are provide in such a manner that fuel can be injected directly to the combustion chamber 4 from between the flame stabilizers 10 and swirl combustion air nozzles 26. At the time of gas fuel combustion, particularly at the time of partial load operation of the gas turbine, carry-over of premixed flame from diffuse flame may not be made well, causing unburned fuel to be ejected. In such a case, gas fuel is injected into the combustion chamber from the auxiliary fuel nozzles 24 disposed in the vicinity of the flame stabilizers 10. Then, the concentration of fuel on the inner circumferential side of the premixture 11 increases, allowing premixture 11 to be combusted completely. Further, if the diffuse gas fuel is reduced so as to decrease NOx, the diffuse flame becomes unstable. Together with the unstable diffuse flame, premixing flame may sway, causing a large oscillatory combustion to occur. In such a case, the diffuse flame can be dispersed by charging the auxiliary fuel 23, enabling the oscillatory combustion to be suppressed.

A combustor according to another embodiment of the present invention will be described with reference to FIG. 11, which is a longitudinal sectional view. Similarly to the embodiment of FIG. 10, a passage through which auxiliary fuel 23 can be supplied is provided. The premixer 6 is located at the upstream portion between the flame stabilizers 10 close to the exit of the premixer. The inner periphery wall of the premixer 6 is provided with auxiliary fuel nozzles 24 through which fuel can be injected into the premixer 6. The fuel ejected from the auxiliary fuel nozzles 24 is mixed with premixture 11 or air for premixing, and the mixed fuel is supplied into the combustion chamber 4 through between the flame stabilizers 10. The effect is similar to that of the embodiment of FIG. 10. However, since auxiliary fuel 23 is mixed partially with the premixture 11 or air for premixing, NOx can be further reduced.

Further, at the time of gas fuel combustion, carry-over of diffusion flame and premixed flame is secured by supplying auxiliary fuel 23. At the same time, oscillatory combustion is reduced by dispersing fuel supplying positions in the radial direction of the combustion chamber radius.

Figure 11:
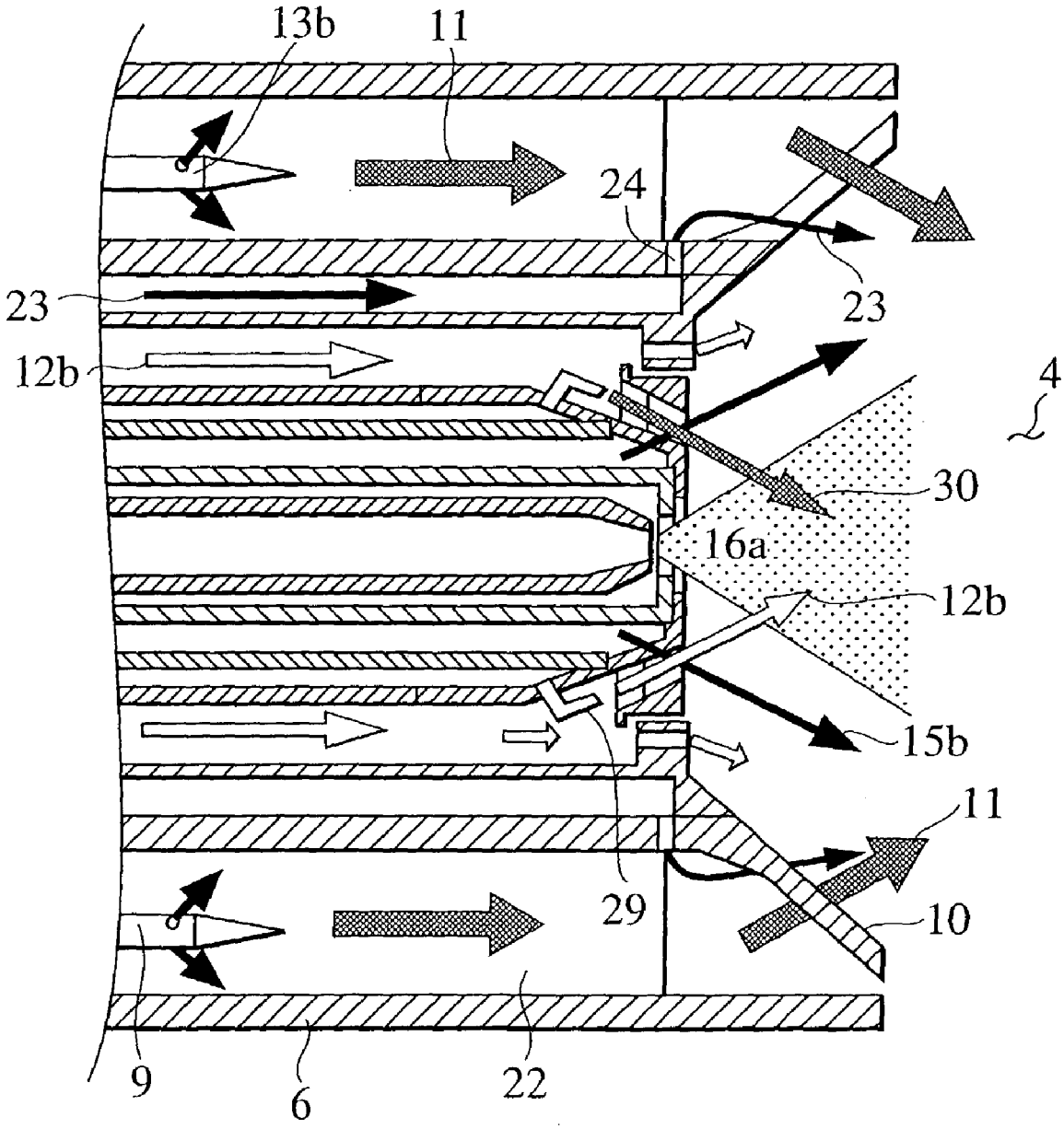
FIG. 11 is a sectional view of another combustor according to the present invention.
Figure 12:
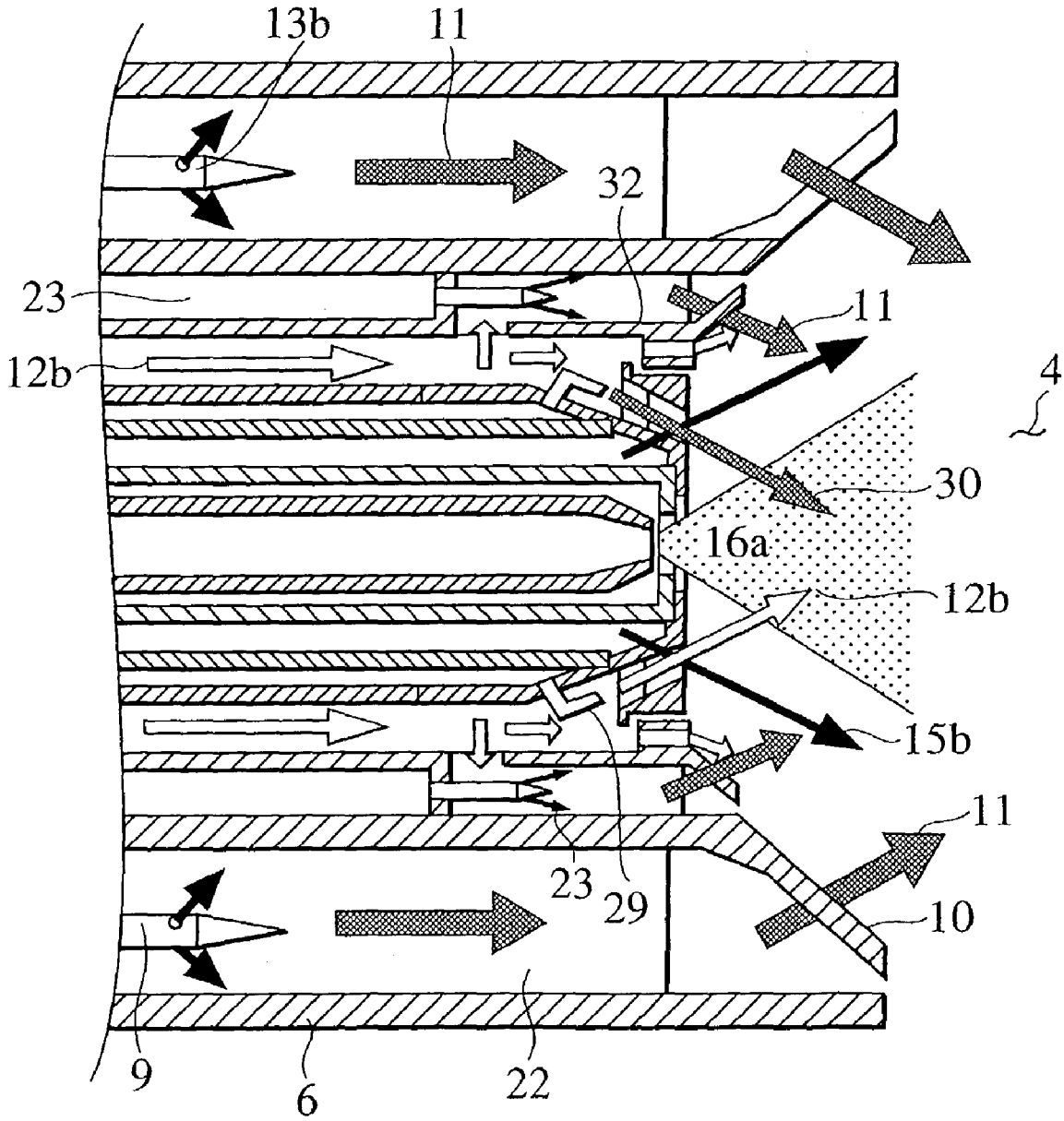
FIG. 12 is a sectional view of another combustor according to the present invention.

Another embodiment of the present invention is described referring to FIG. 12 in relation to the combustor of FIGS. 10 and 11. FIG. 12 shows an auxiliary premixer 32 provided between the premixer 6 and diffusion swirl burner 5. The oscillatory combustion suppressing effect and reduction of unburned fuel at the time of partial loads are similar to those of the combustors of FIGS. 10 and 11. However, since radial type flame stabilizers 10' are provided also at the exit of the auxiliary premixer 32, the premixing flame made by the auxiliary fuel 23 is stabilized. Further, since the diffusion flame can pass through the face, of the flame stabilizers 10', in contact with the combustion chamber 4 of the auxiliary premixer 32, NOx can be further reduced without impairing flame propagating performance toward the adjacent furnace at the time of ignition and uniform temperature characteristics at the exit of the combustor.

Next, a description will below be made of a method of remodeling an already existing gas turbine combustor provided with a pilot burner and a premixed combustion burner disposed on the periphery of the pilot burner by providing flame stabilizers. When providing the radially disposed flame stabilizers on an already existing gas turbine combustor equipped with a pilot burner and a premixed combustion burner disposed on the periphery of the pilot burner, the flame stabilizers must be slanted so that the outer circumferential side thereof is positioned on the downstream side thereof relative to the inner circumferential side at edges on the downstream side. Further, desirably, the inclination angle relative to the combustor center axis must be 30° or more and 60° or less. With this construction, a premixed combustion gas on the outer circumferential side deflects in the direction in which the premixed combustion gas converges to the axial center of the combustor after passing through the edge on the front side of the flame stabilizers, causing diffusion combustion gas on the inner circumferential side to be diluted and mixed sufficiently. As a result, extension of diffusion flame is prevented to reduce the production of NOx, and occurrence of combustion temperature deviation at the exit of the combustor is prevented, protecting damage to turbine blades. Next, when providing radially disposed flame stabilizers, the inner circumference of the flame stabilizers is fixed in a cantilever manner. In other words, the flame stabilizers are supported (fixed) on the premixed combustion burner on the inner circumference side of the flame stabilizers 10, and the edges on the outer circumferential side of the flame stabilizers 10 is separated from the outer circumferential wall of the premixed combustion burner. With this construction, stress caused by the thermal expansion and the like of the flame stabilizers 10 can be released. Further, with this construction, premixed fuel 11 or air ejected into the combustion chamber through the space between the edge on the downstream side of the flame stabilizers 10 and the outer circumferential wall of the premixed combustion burner prevents a rise in the temperature of combustion chamber sidewall due to diffusion flame. As described above, in a gas turbine of such a type as that the already installed combustor is equipped with a pilot burner and a premixed combustion burner disposed on the outer circumference of the pilot burner, the already existing combustor is not replaced of a new combustor produced by providing the radially disposed flame stabilizers 10 thereto but the already existing combustor is remodeled by providing the radially disposed flame stabilizers 10 thereto, whereby approximately equivalent performance can be displayed and production cost can be reduced.

As described above, combustion forms adaptable to gas and liquid fuel can be realized by applying the present invention to gas turbine combustors, and both stabilization of fuel and reduction of NOx can be compatible. Further, mixing of fuel with air is promoted at a combustion field, causing the temperature of fuel gas at the entrance of the gas turbine to be uniformed, and damage to turbine blades can be prevented. Furthermore, when a gas turbine system comprises multiple combustors and cross-fire tubes are used to ignite the individual combustors, the present invention improves the flame propagating performance, enabling a range of ignition to expand.

Further, also in the case of an already existing gas turbine combustor equipped with a pilot burner and a premixed combustion burner disposed on the outer circumference of the pilot burner, the same effect as that of a gas turbine combustor equipped with radially disposed flame stabilizers from the beginning can be expected by providing the radially disposed flame stabilizers at the exit of the premixed combustion burner.

According to the present invention, there are provided a gas turbine combustor that provides adequate combustion using combustors capable of using gas fuel and liquid fuel, and low-NOx performance, as well as a combustion method of the gas turbine combustor and a method of remodeling a gas turbine combustor.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A gas turbine combustor comprising:

a pilot burner;

a premixed combustion burner disposed on the circumference of said pilot burner;

a liner in an approximately cylindrical shape which is disposed on the downstream side of said premixed combustion burner, and which defines a combustion chamber in the liner; and a plurality of flame stabilizers radially disposed at the exit of said premixed combustion burner, said plurality of flame stabilizers being formed as a plurality of radial projections each projecting from an inner circumferential side thereof to an outer circumferential side thereof, and said plurality of flame stabilizers being arranged in a cantilever manner on said inner circumferential side such that said flame stabilizers form narrowed passages between the adjacent flame stabilizers;

wherein the pilot burner is provided with a fuel injection means which ejects at least one of gas fuel and liquid fuel, and a plurality of air nozzles for injecting air into said combustion chamber are located on the outside of said pilot burner and the inside of said premixed combustion chamber.

2. The gas turbine combustor according to claim 1, further comprising a cross-fire tube provided with an opening which is disposed at the side wall of said liner and which is circumferentially aligned with one of said flame stabilizers.

3. The gas turbine combustor according to claim 1, wherein said flame stabilizers are each inclined so that the outer circumferential side thereof is positioned on the downstream side relative to the inner circumferential side thereof at the edge thereof on the downstream side, and the inclination angle of the flame stabilizer is 30° or more and 60° or less relative to the center axis of the combustor.

4. The gas turbine combustor according to claim 1, wherein the inner circumferential sides of said flame stabilizers are fixed to said premixed combustion burner, and edges, on the outer periphery side, of said flame stabilizers are separated from the outer circumferential wall of said premixed combustion burner.

5. The gas turbine combustor according to claim 1, wherein said air nozzle is configured in such a manner as to spout out air swirlingly.

6. A gas turbine combustor comprising:

a pilot burner;

a premixed combustion burner disposed on the circumferential of said pilot burner;

a liner in an approximately cylindrical shape which is disposed on the downstream side of said premixed combustion burner and which defines a combustion chamber in the liner; and a plurality of flame stabilizers radially disposed at the exit of said premixed combustion burner, said flame stabilizers being formed as a plurality of radial projections each projecting from an inner circumferential side thereof to an outer circumferential side thereof;

wherein the pilot burner is provided with a fuel injection means which ejects at least one of gas fuel and liquid fuel, and a plurality of air nozzles for injecting air into the combustion chamber are located on the outside of said pilot burner and the inside of said premixed combustion chamber;

wherein a slit is provided outside said air nozzle and inside said premixed combustion burner, and a means of allowing air to flow toward the flame stabilizer is provided in said slit.

7. The gas turbine combustor according to claim 1, wherein an air inlet portion or an air outlet portion of said pilot burner is provided with a nozzle capable of ejecting water or steam.

8. The gas turbine combustor according to claim 1, further comprising a partition which divides a passage of said premixed combustion burner in the circumferential direction.

9. A gas turbine combustor comprising:

a pilot burner which is provided with a fuel injection means capable of injecting gas fuel and liquid fuel;

a premixed combustion burner disposed in the outer circumference of said pilot burner;

a liner in an approximately cylindrical shape which is disposed on the downstream side of said premixed combustion burner, and which defines a combustion chamber in the inner wall; and a plurality of flame stabilizers radially disposed at the exit of said premixed combustion burner, said plurality of flame stabilizers being formed as a plurality of radial projections each projecting from an inner circumferential side thereof to an outer circumferential side thereof, and said plurality of flame stabilizers being arranged in a cantilever manner on said inner circumferential side such that said flame stabilizers form narrowed passages between the adjacent flame stabilizers;

wherein said flame stabilizers are slantly disposed so that the outer circumferential side thereof is positioned on the downstream side thereof relative to the inner circumferential side at the edge, on the downstream side, of the flame stabilizer, said flame stabilizers are fixed to said premixed combustion burner on the inner circumferential side, and edges, on the outer circumferential side, of said flame stabilizers are separated from the outer circumferential wall of said premixed combustion burner.

10. A combustion method of a gas turbine combustor including a pilot burner, a premixed combustion burner disposed on the outer circumference of said pilot burner, and a liner in an approximately cylindrical shape which is disposed on the downstream side of said premixed combustion burner, and which defines a combustion chamber in the inner wall, comprising the steps of:

disposing a plurality of flame stabilizers radially at the exit of said premixed combustion burner, said plurality of flame stabilizers being formed as a plurality of radial projections each projecting from an inner circumferential side thereof to an outer circumferential side thereof, and said plurality of flame stabilizers being arranged in a cantilever manner on said inner circumferential side such that said flame stabilizers form narrowed passages between the adjacent flame stabilizers;

injecting at least one of gas fuel and liquid fuel from said pilot burner; and spouting out air into said combustion chamber from a plurality of air nozzles disposed outside said pilot burner and inside said premixed combustion burner.

11. A method of remodeling a gas turbine combustor comprising: a pilot burner which is provided with a fuel injection means capable of injecting gas fuel and liquid fuel; a premixed combustion burner disposed within a premixed fuel passage on the outer circumference of said pilot burner;

and a combustor liner in an approximately cylindrical shape which is disposed on the downstream side of said premixed combustion burner, and which defines a combustion chamber therein;

said method characterized in that a plurality of flame stabilizers are radially disposed at the exit of said premixed combustion burner, said plurality of flame stabilizers being formed as a plurality of radial projections each projecting from an inner circumferential side thereof to an outer circumferential side thereof, and said plurality of flame stabilizers being arranged in a cantilever manner on said inner circumferential side such that said flame stabilizers form narrowed passages between the adjacent flame stabilizers, said flame stabilizers are slantly disposed so that the outer circumferential side thereof is positioned on the downstream side thereof relative to the inner circumferential side, and edges on the outer circumferential side of said flame stabilizers and outer circumferential wall of said premixed combustion burner are disposed so as to define a space between said edges and said outer circumferential wall.

12. A premixed type gas turbine combustor comprising:

a pilot burner;

an annular premixed fuel passage disposed on the outer circumference of said pilot burner; and a combustor liner in an approximately cylindrical shape which is disposed on the downstream side of said annular premixed fuel passage, and which defines a combustion chamber therein;

wherein said premixed type gas turbine combustor comprises a plurality of means for making said annular premixed fuel passage facing said combustion chamber narrow in the circumferential direction to form a plurality of narrowed passages in said annular premixed fuel passage facing said combustion chamber, and said annular premixed fuel passage facing said combustion chamber is configured such that fluids in said plurality of narrowed passages formed in said annular premixed fuel passage by said means are directed toward the center side of the combustor, and intersect fuel spouted out from said pilot burner.

* * * * *